US012096834B2

(12) United States Patent
Thompson et al.

(10) Patent No.: US 12,096,834 B2
(45) Date of Patent: Sep. 24, 2024

(54) ATTACHMENT FOR A HANDHELD APPLIANCE

(71) Applicant: Dyson Technology Limited, Wiltshire (GB)

(72) Inventors: Daniel John Thompson, Bristol (GB); Chong Wei Pang, Singapore (SG); Gautham Ramesh, Singapore (SG); Wee Jin Sim, Singapore (SG); Andrew Drummond Flynn, Bristol (GB); Britta Jessica Stockinger, Bath (GB)

(73) Assignee: Dyson Technology Limited, Malmesbury (GB)

( * ) Notice: Subject to any disclaimer, the term of this patent is extended or adjusted under 35 U.S.C. 154(b) by 939 days.

(21) Appl. No.: 16/973,745

(22) PCT Filed: Apr. 5, 2019

(86) PCT No.: PCT/GB2019/051004
§ 371 (c)(1),
(2) Date: Dec. 9, 2020

(87) PCT Pub. No.: WO2019/239092
PCT Pub. Date: Dec. 19, 2019

(65) Prior Publication Data

US 2021/0251364 A1 Aug. 19, 2021

(30) Foreign Application Priority Data

Jun. 11, 2018 (GB) ..... 1809536

(51) Int. Cl.
*A45D 20/12* (2006.01)

(52) U.S. Cl.
CPC ..... *A45D 20/122* (2013.01)

(58) Field of Classification Search
None
See application file for complete search history.

(56) References Cited

U.S. PATENT DOCUMENTS

2013/0199372 A1* 8/2013 Nock ..... B05B 1/14 239/548
2014/0144037 A1 5/2014 Hadden
2016/0206076 A1 7/2016 Stephens et al.
2016/0206077 A1 7/2016 Stephens et al.
(Continued)

FOREIGN PATENT DOCUMENTS

CN 203884937 U 10/2014
CN 204132666 U 2/2015
(Continued)

OTHER PUBLICATIONS

Examination Report dated Jan. 20, 2021 directed to GB Application No. 1809536.4; 2 pages.
(Continued)

*Primary Examiner* — Jason Lau
(74) *Attorney, Agent, or Firm* — Tucker Ellis LLP; Michael G. Craig

(57) ABSTRACT

An attachment for a hair styling apparatus, the attachment comprising an annular duct having an air inlet for receiving an airflow from a hair styling apparatus, and at least one vane located within the duct for directing the airflow from the air inlet towards an air outlet.

18 Claims, 8 Drawing Sheets

(56) References Cited

U.S. PATENT DOCUMENTS

| | | | |
|---|---|---|---|
| 2017/0273423 | A1 | 9/2017 | Mason et al. |
| 2017/0273425 | A1 | 9/2017 | Stephens et al. |
| 2017/0273426 | A1 | 9/2017 | Thompson et al. |
| 2019/0357654 | A1 | 11/2019 | MacPherson et al. |

FOREIGN PATENT DOCUMENTS

| | | | |
|---|---|---|---|
| CN | 105795679 | A | 7/2016 |
| CN | 107224077 | A | 10/2017 |
| CN | 107224082 | A | 10/2017 |
| CN | 107373987 | A | 11/2017 |
| CN | 210539519 | U | 5/2020 |
| EP | 3319473 | B1 | 2/2021 |
| GB | 2503519 | A | 1/2014 |
| GB | 2534379 | A | 7/2016 |
| GB | 2548617 | A | 9/2017 |
| GB | 2548619 | A | 9/2017 |
| JP | 2010-274050 | A | 12/2010 |
| JP | 2016-131890 | A | 7/2016 |
| JP | 2017-170145 | A | 9/2017 |
| KR | 10-2018-0030620 | A | 3/2018 |
| WO | 2014/006365 | A1 | 1/2014 |
| WO | 2016/116730 | A1 | 7/2016 |

OTHER PUBLICATIONS

Office Action received for Japanese Patent Application No. 2020-568434, mailed on Feb. 15, 2022, 5 pages (3 pages of English Translation and 2 pages of Original Document).

Office Action received for Chinese Patent Application No. 201910433523.8, mailed on May 7, 2022, 16 pages (9 pages of English Translation and 7 pages of Original Document).

Office Action received for Korean Patent Application No. 10-2020-7037336, mailed on Jan. 20, 2022, 11 pages (5 pages of English Translation and 6 pages of Original Document).

International Search Report and Written Opinion mailed Jun. 24, 2019, directed to International Application No. PCT/GB2019/051004; 11 pages.

Search Report dated Nov. 29, 2018, directed to GB Application No. 1809536.4; 1 page.

* cited by examiner

ATTACHMENT FOR A HANDHELD APPLIANCE

CROSS-REFERENCE TO RELATED APPLICATIONS

This application is a national stage application under 35 USC 371 of International Application No. PCT/GB2019/051004, filed Apr. 5, 2019, which claims the priority of GB Application No. 1809536.4, filed Jun. 11, 2018, the entire contents of each of which are incorporated herein by reference.

FIELD OF THE DISCLOSURE

The present invention relates to an attachment for a handheld appliance, in particular a hair care appliance such as a hot air styling device or hair dryer.

BACKGROUND OF THE DISCLOSURE

In a conventional hot air styling device, air is drawn into an inlet by a fan unit and directed towards the hair by an attachment or head. Depending on the style desired, the airflow may or may not be heated. Removable attachments are attached to the airflow outlet end of the hot air styling device or hairdryer, and serve to modify the velocity and form of the airflow emitted from the hot air styling device before it is incident upon the hair of the user.

A concentrator is a known attachment which focuses and flattens the emitted airflow. Another known attachment is a diffuser which reduces the velocity of the emitted airflow. Heated airflow through an attachment may cause an outer surface of the attachment to become uncomfortably hot to touch. It is desirable to mitigate excessive heat on the outer surface whilst not impeding the drying and styling function of the attachment.

SUMMARY OF THE DISCLOSURE

In a first aspect, the present invention provides an attachment for a hair styling apparatus comprising an air inlet for receiving airflow from a hair styling apparatus, an annular air outlet, a duct for conveying air from the air inlet to the air outlet, wherein the air outlet is located at a front edge of the duct and is orientated generally parallel to the direction of airflow at the air inlet.

Advantageously, the attachment functions as a rough drying tool and the emitted airflow experienced by the user is generally uniform in temperature and velocity.

Preferably, the air outlet has a substantially constant width, W, which is in the range from 0.5 to 4.0 mm, and more preferably, in the range from 1.0 to 2.0 mm. Preferably, the duct has a substantially constant width, D, which is in the range from 2.0 to 5.0 mm, and more preferably, in the range from 3.0 to 4.0 mm.

In a preferred embodiment, the duct has a cross-sectional area which gradually decreases with increasing proximity to the front edge of the duct. Further, the duct is preferably defined by an inner wall and an outer wall, and the outer wall is gradually inclined towards the inner wall in proximity to the front edge of the duct.

In a second aspect, the present invention provides an attachment for a hair styling apparatus comprising an annular duct having an air inlet for receiving an airflow from a hair styling apparatus, at least one vane located within the duct for directing the airflow from the air inlet towards an air outlet.

Advantage is found in utilizing one or more vanes within the duct in order to direct the inlet airflow smoothly, through approximately 90 degrees, towards the air outlet. The vanes may also be referred to a "baffles".

Preferably, said at least one vane is noncontiguous with the air outlet. Preferably, said at least one vane is set back from the air outlet by a distance in the range of 2 to 9 mm, and more preferably, in the range of 4 to 7 mm.

In a preferred embodiment, the duct is defined by an inner wall and an outer wall, and said at least one vane is a lamina extending between the inner wall and the outer wall.

Preferably, the duct has a curved top section joined to a curved lower section by straight side sections, and said at least one vane is positioned within the straight side sections.

Advantageously, turbulent airflow is minimized within the attachment and consequently the audible volume of the hot air styling device with attachment is minimized in use.

It is preferred that said at least one vane has an aerofoil-shaped cross-section. Preferably, said at least one vane is a split vane having a minor section and a major section. Furthermore, there may be two or more vanes and each vane may have an arc form. In a preferred embodiment, five vanes are fixed within the duct.

In a third aspect, the present invention provides an attachment for a hair styling apparatus comprising a primary air inlet for receiving airflow from a hair styling apparatus, a first duct for conveying airflow from the primary air inlet to a primary air outlet, an external wall which surrounds the first duct to define a second duct therebetween, wherein a terminal edge of the external wall extends beyond the primary air outlet, and the external wall comprises an inclined portion in proximity to the terminal edge. Preferably, the inclined portion is a chamfer.

Where the airflow entering the primary air inlet is warm, the inner wall and outer wall may become warm during use. The cool wall functions to minimize the temperature of the outermost surface of the attachment, as the air-filled second duct insulates the cool wall from the outer wall.

Advantageously the cool wall minimizes the surface touch temperature of the attachment in use.

Preferably, the terminal edge of the external wall extends beyond end of the primary air outlet by 2.5-4.5 mm, and more preferably by 3.0-4.0 mm.

In a preferred embodiment, the terminal edge of the external wall defines an elongate circle. Further, the primary air inlet may be circular and the primary air outlet may be annular. Preferably, the second duct conveys airflow from a secondary air inlet to a secondary air outlet; and the secondary air inlet comprises at least one port in fluid communication with the ambient atmosphere. Each of the ports may be in the form of a slot, and each slot may be annular in shape. Each of the ports may be located proximate to a back face of the attachment.

Preferably, the external wall has a curved top section joined to a curved lower section by straight side sections, and the lower section may be adapted to form a collar for engagement with the hair styling apparatus.

In a fourth aspect, the present invention provides an attachment for a hair styling apparatus, the attachment comprising an outer wall having a generally tubular form, the outer wall comprising an air inlet port in a side of the outer wall, and an air outlet aperture at an open end of the outer wall, and an inner wall having a generally tubular form, the inner wall comprising a plurality of circumferentially spaced weld ribs to which the outer wall is ultrasonically welded.

Such ribs are provided on the outer surface of the outer wall arrangement and function to maintain a substantially constant spacing between the outer wall arrangement and the coolwall.

Preferably, the inner wall comprises a first end which defines a side of the air outlet aperture, and a second end having at least one flange. In a preferred embodiment, the inner wall comprises at least one connector and the outer wall comprises at least one connector, and wherein one of the connectors comprises a male connector and the other one of the connectors comprises a female connector for receiving the male connector.

The male and female connectors may comprise a laminae protrusion and receiving slot, respectively. The attachment may further comprise a plastics external wall which surrounds the outer wall to define an air channel therebetween. The outer wall may comprise a plurality of angularly spaced weld ribs which are ultrasonically welded to an air outlet end of the external wall. Furthermore, the attachment may comprise a series of spaced laminae vanes is located between the inner wall and the outer wall, wherein the series of vanes are ultrasonically welded to an inner surface of the outer wall.

Preferably, the attachment further comprises a back plate having an annular form which engages with each of the inner wall and the external wall, and the back plate may comprise an inner flange which engages with the second end of the inner wall via a friction fit and a secondary fixing structure. Further, the secondary fixing structure comprises a plastics clip member. It is preferable for the back plate to comprise a locating lip which engages in friction-fit contact with the external wall and the outer wall.

In a fifth aspect, the present invention provides a method of assembling an attachment, comprising the steps of providing an outer wall having a generally tubular form, the outer wall comprising an air inlet port in a side of the outer wall, and an air outlet aperture at an open end of the outer wall, and providing an inner wall having a generally tubular form, the inner wall comprising a plurality of circumferentially spaced weld ribs, positioning the outer wall around the inner wall, and ultrasonically welding the outer wall to the weld ribs.

Preferably, the method further comprises the steps of providing a plurality of angularly spaced weld ribs on the outer wall, providing a plastics external wall having a generally tubular form, positioning the external wall over the outer wall, and ultrasonically welding the weld ribs to the external wall.

The method may comprise the steps of providing a plastics back plate, the back plate comprising a locating lip and a secondary fixing structure and an inner flange, positioning the back plate at a distal end to the air outlet aperture, and engaging the locating lip and secondary fixing structure with the external wall, and engaging the inner flange with the inner wall.

Features described above in connection with the first aspect of the invention are equally applicable to the further aspects of the invention, and vice versa.

BRIEF DESCRIPTION OF THE FIGURES

Preferred features of the present invention will now be described by way of example only with reference to the accompanying drawings, in which.

DETAILED DESCRIPTION OF THE DISCLOSURE

Figure 2:
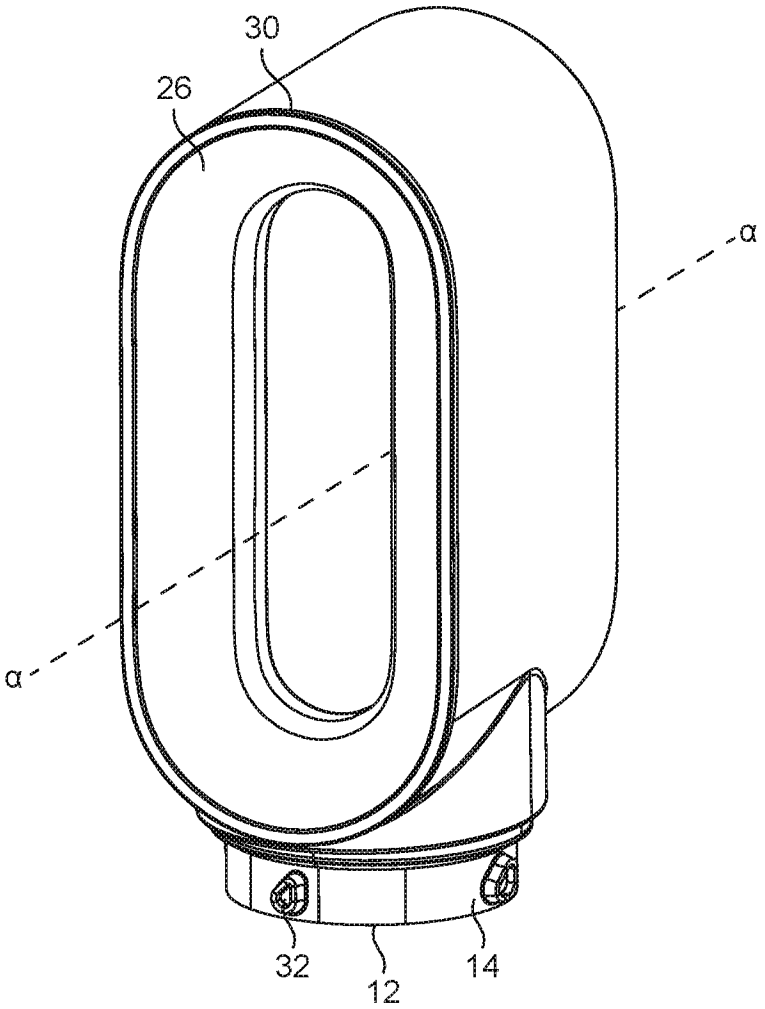
FIG. 2 is a rear perspective view of the attachment.
Figure 1:
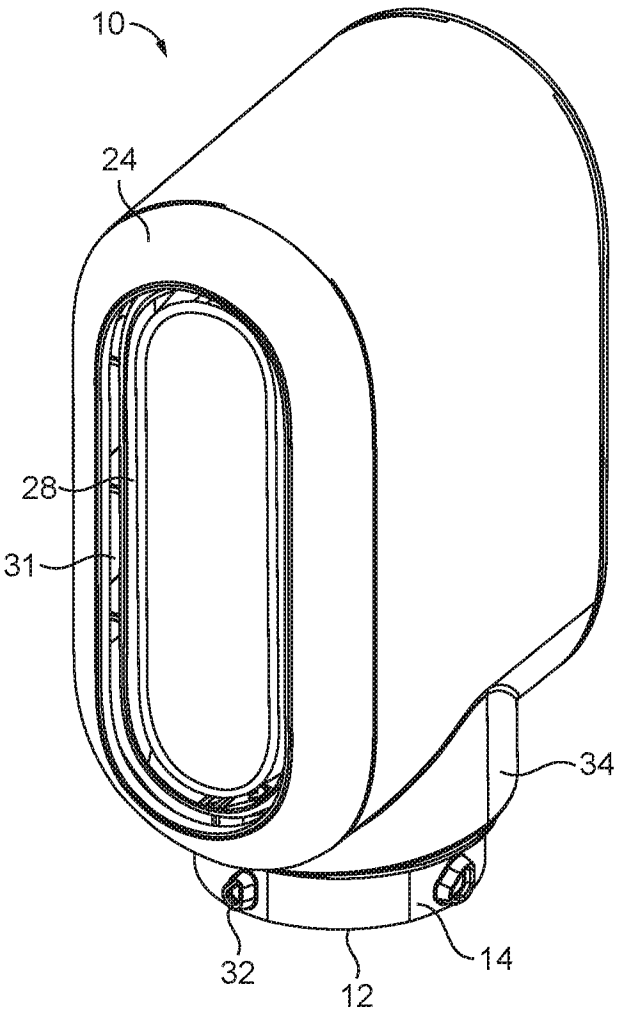
FIG. 1 is a front perspective view of an attachment.
Figure 3:
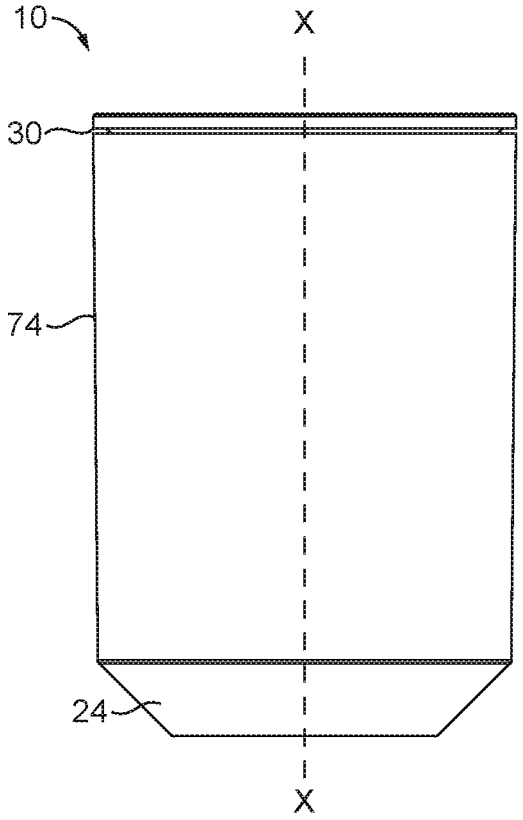
FIG. 3 is a top view of the attachment.
Figure 4:
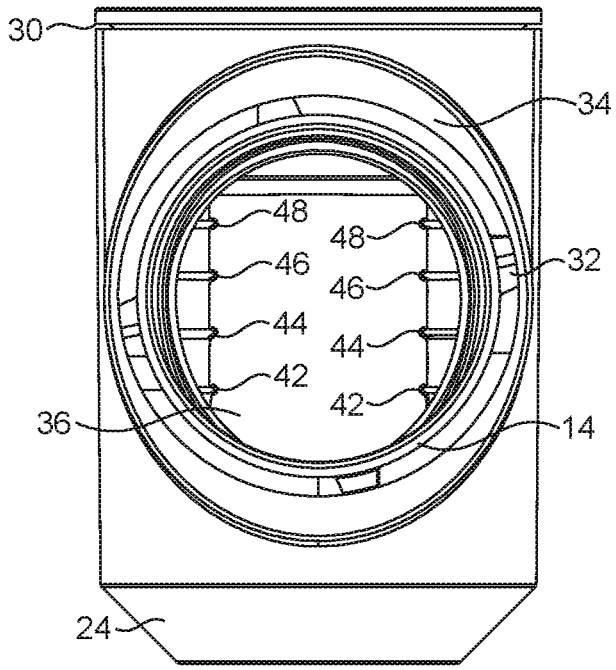
FIG. 4 is a base view of the attachment.

FIGS. 1 to 5 and 7 to 8, are external views of an attachment 10. The attachment 10 comprises an air inlet 12 for receiving airflow from an air outlet end of a hot air styling device or similar apparatus. The air inlet 12 is defined by a collar 14 which is generally circular in shape, to enable an air-tight connection with a generally circular air outlet end of the hot air styling device.

The general form of the attachment 10 is an elongate annular cylinder oriented transverse to the direction of the airflow incident from the hot air styling device. The elongate annular cylinder form comprises two planar, parallel side sections and a semi-tubular top section and a generally semi-tubular lower section. Both a front face 24 and a back face 26 of the attachment are an elongate annulus form, which may also be referred to as a stadium shape. The attachment 10 comprises a primary outlet 28 which is an annular slot extending around an inner edge of the front face 24 of the attachment 10. A secondary air inlet 30 is an annular slot extending around an outer edge of the attachment in proximity to the back face 26.

The annular front face 24 of the external surface of the attachment 10 is outwardly inclined, away from the centre of the attachment 10, and towards attachment axis a (as shown in FIG. 2). The annular back face 26 of the external surface of the attachment is inwardly inclined, towards the centre of the attachment 10.

Figure 5:
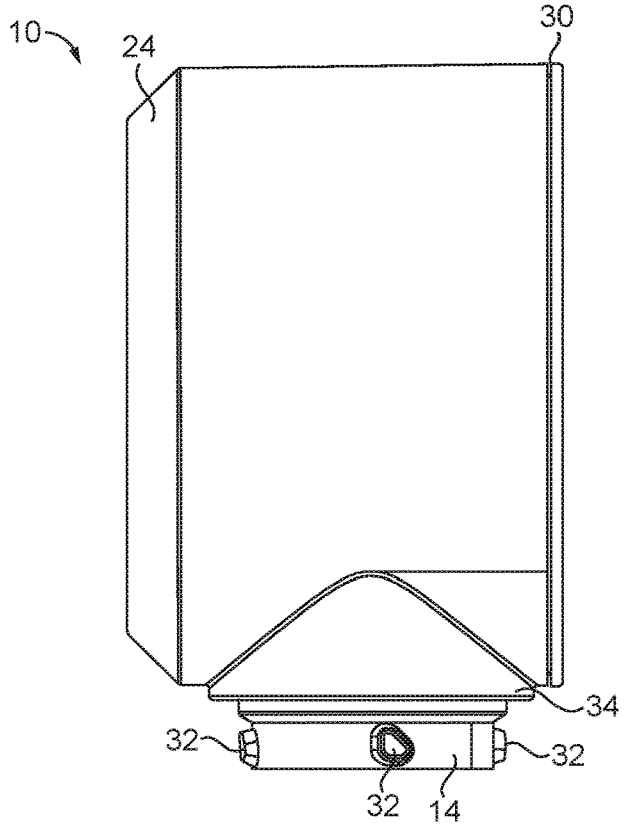
FIG. 5 is a side view of the attachment.

With reference to FIG. 5, in particular, an outer surface of the collar 14 has one or more locating protrusions 32 thereon, to enable secure engagement with the air outlet end of the hot air styling device. The collar 14 is joined to the annular cylindrical part of the attachment via a tubular neck portion 34.

Figure 9:
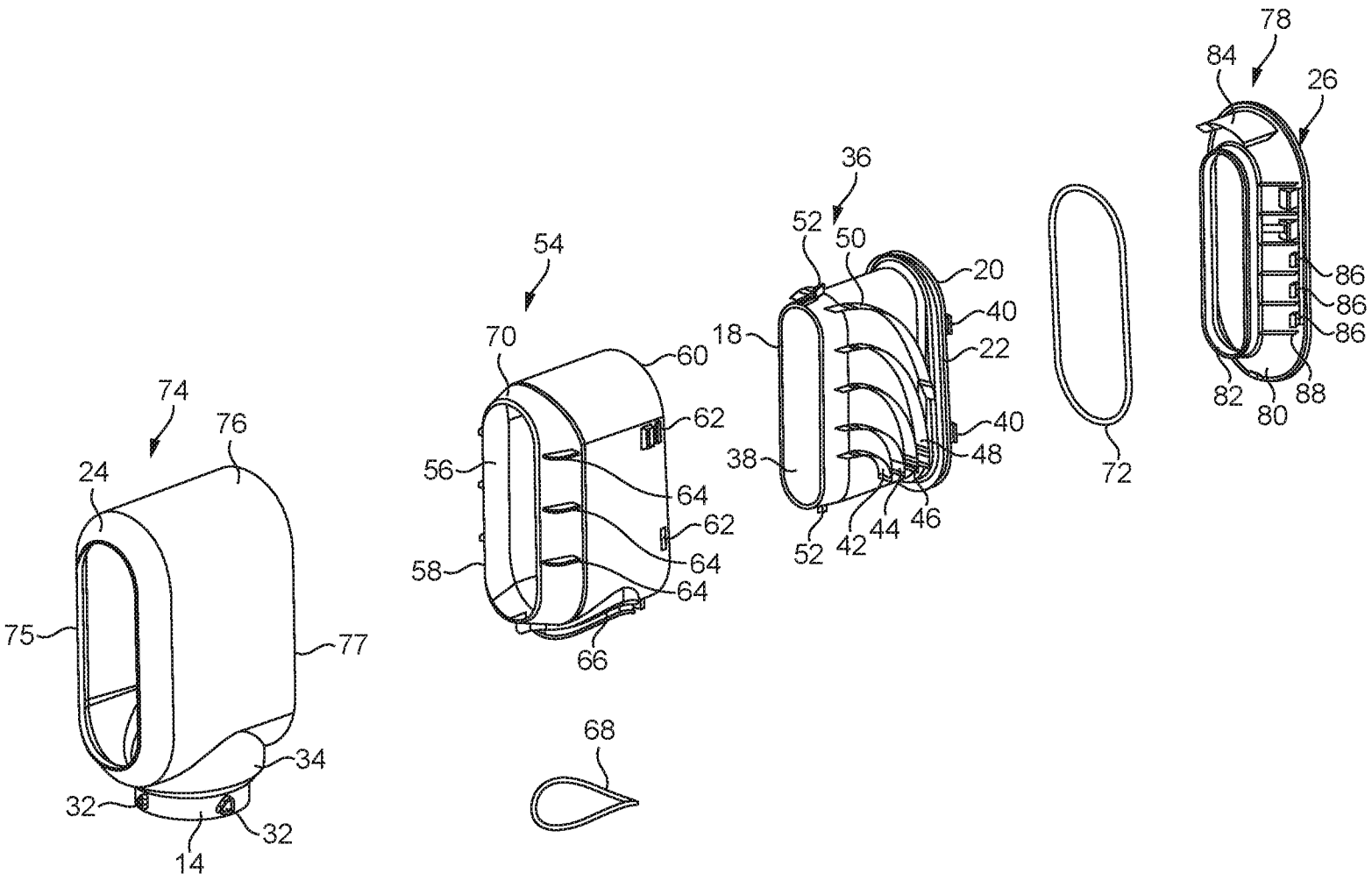
FIG. 9 is a front exploded view of the attachment.

FIG. 9 illustrates the components comprising the attachment. A first component 36 defines an inner wall 38 of the attachment 10 and has an elongate cylinder form, comprising two planar, parallel side sections and a semi-tubular top section and a generally semi-tubular lower section. A first end 18 of the inner wall 38 partly defines the primary air outlet and a second end 20 of the inner wall 38 has several flanges 22. Several short rectangular protrusions 40 extend from one of the flanges 22. The inner wall 38 has a plurality of vanes on an outer surface of both planar side sections. Five vanes 42, 44, 46, 48, 50 are illustrated and each vane is formed of a curved, narrow lamina. The vanes 42, 44, 46, 48, 50 are oriented approximately parallel to the collar in proximity to the air inlet and oriented transverse to the collar in proximity to the air outlet. A first vane 42 is shortest in length and three further vanes 44, 46, 48 have a progressively greater length. The fifth vane 50 extends from part way along the parallel side section of the first component 36 until it is in proximity to the air outlet 18. An inner wall rib 52 protrudes from each of the semi-tubular top section and the semi-tubular lower section of the inner wall 38.

A second component 54 defines an outer wall 56 of the attachment 10 and has an elongate cylinder form, comprising two planar, parallel side sections and a semi-tubular top section and a generally semi-tubular lower section. A first end 58 of the outer wall 56 partly defines the primary air outlet, and a second end 60 of the outer wall 56 has several slots 62 which engage with the rectangular protrusions 40 extending from the second end 20 of the inner wall 38. A plurality of locating ribs 64 are located on an outer surface of the outer wall 56, adjacent to the air outlet. The lower section of the outer wall 56 comprises a neck 66 defining the air inlet of the attachment. The second component 54 has a gradually inclined section 70 at the first end 58 of the component.

A first elastic O-ring 68 is fitted over the outer surface of the neck 66. A second elastic O-ring 72 is positioned over the flanges 22 towards the second end 20 of the first component 36.

A third component 74 defines a cool wall 76 of the attachment 10 and has an elongate cylinder form, comprising two planar, parallel side sections and a semi-tubular top section and a generally semi-tubular lower section. The lower section of the cool wall 76 comprises the tubular neck 34 which is joined to the collar 14. At a first end 75 of the cool wall 76, the annular front face 24 is outwardly inclined, away from the centre of the attachment 10. The centre of the attachment 10 is considered to be the mid-point of each of the height, width and breadth of the elongate cylinder section of the attachment 10.

A fourth component 78 defines a back plate 80 having an annular form comprising two straight, parallel side sections joined by a curved top section and curved lower section. The back plate 80 is inwardly inclined, towards the centre of the attachment 10, and has an inner flange 82 at an inner edge of the annular form, extending parallel to axis a. A locating lip 84 is attached to an outer edge of the curved top section of the annular back plate 80 and extends parallel to axis a. A series of connecting clips 86 are located on an inner face of the fourth component 78, along each of the two straight, parallel side sections. The connecting clips 86 engage with receiving entities on an inner surface of the third component 74.

A series of ribs 88 are located on an inner face of the fourth component 78, alternating with the series of connecting clips 86. In FIG. 9, six ribs 88 are shown extending between the outer edge of the back plate and the inner flange 82 and these ribs function to avoid ingress of hair.

During assembly of these four components 36 54 74 78, the second end 60 of the outer wall 56 is moved over the first end 18 of the inner wall 38 and further moved along until the second end 60 of the outer wall 56 engages with the flanges 22 at the second end 20 of the inner wall 38. In particular, the slots 62 at the second end 60 of the outer wall 56 engage with the rectangular protrusions 40 extending from the flanges 22 at the second end 20 of the inner wall 38.

Figure 6:
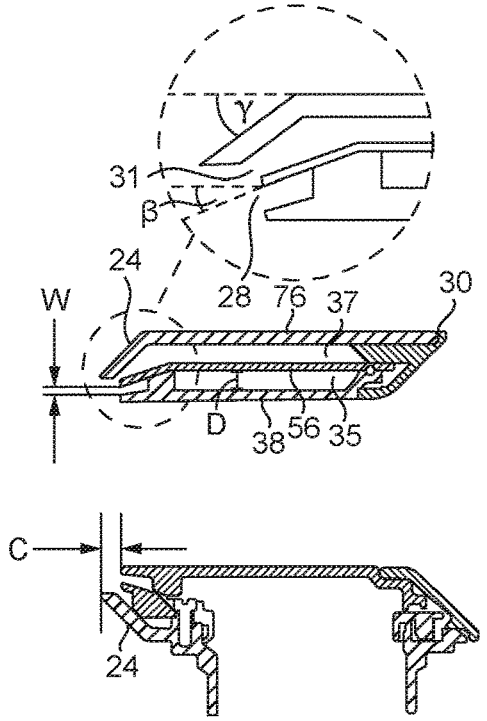
FIG. 6 is a side sectional view of the attachment taken along line X-X in FIG. 3.

With reference to FIGS. 6 and 9, the vanes 42, 44, 46, 48, 50 and inner wall ribs 52 on the inner wall 38 function to maintain a first duct 35 between the outer wall 56 and the inner wall 38. The vanes 42, 44, 46, 48, 50 and inner wall ribs 52 are fused to the inner surface of the outer wall 56 by, for example, ultrasonic welding. Such a fused structure also functions to add rigidity to the outer wall arrangement.

The second end 77 of the cool wall 76 is moved over the first end 58 of the outer wall arrangement and further moved along until an inner surface of the annular front face 24 of the cool wall 76 abuts the plurality of locating ribs 64 on the outer wall arrangement. The locating ribs 64 can be fused to the inner surface of the cool wall 76 by, for example, ultrasonic welding. Such a fused structure also functions to add rigidity to the attachment 10.

Finally, the back plate 80 is positioned at the second end 77 of the cool wall 76 thereby enclosing the outer wall arrangement within the cool wall 76. The locating lip 84 slides inside the semi-tubular top section of the cool wall 76 and the inner flange 82 cooperates with the second end 20 of the inner wall 38.

The complete arrangement is secured together at multiple points within the attachment 10 using one or more of glue, screws, ultrasonic welding and push-fit fixings.

Figure 10:
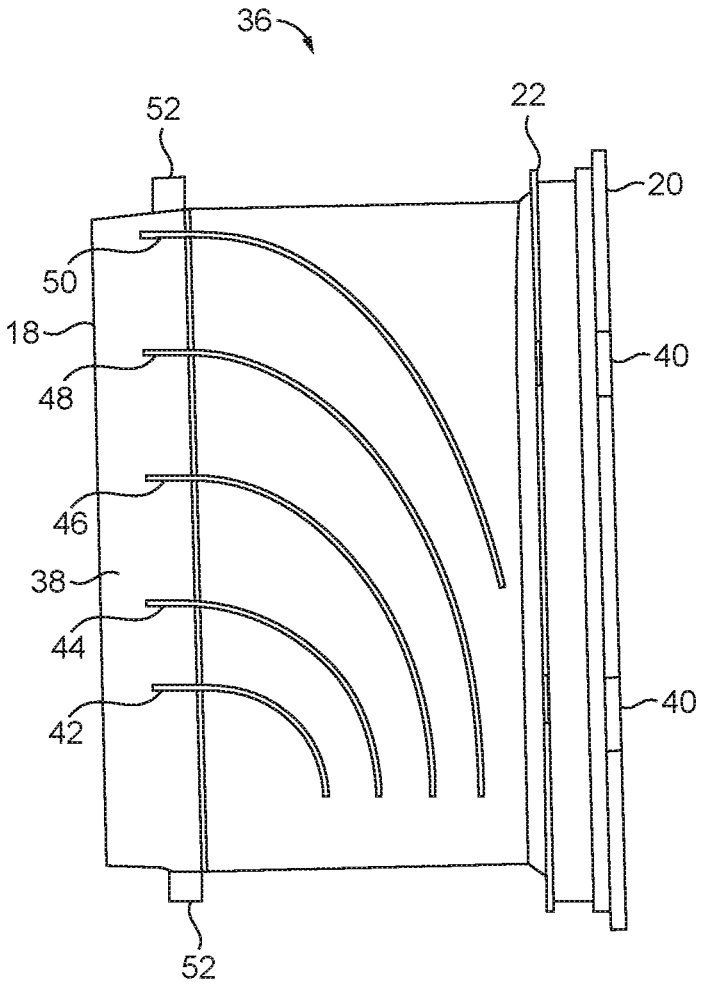
FIG. 10 is a side view of an inner wall.

A preferred embodiment of the attachment 10, illustrated in FIG. 10, has a series of five vanes 42, 44, 46, 48, 50. The vanes function to guide airflow from the primary air inlet 12 to the primary air outlet 28 whilst preventing any turbulent flow occurring within the first duct 35. With reference to FIG. 10, each vane 42, 44, 46, 48, 50 has a different length and form which is optimized to enable the whole arrangement of vanes to:

- initially harness the incident airflow,
- guide the airflow towards the primary air outlet, whilst minimizing airflow dead spots, and finally,
- emit the airflow with an even velocity and a balanced distribution around the entire primary air outlet.

Contours of each vane 42, 44, 46, 48, 50 allow attachment of the airflow along the length of each vane. Further, the vanes guide the airflow emitted at the primary air outlet 28 such that the airflow emitted has a relatively slow velocity decay and leaves the first duct 35 uniformly at right-angles to the direction of the incident airflow into the attachment 10. In an exemplary embodiment, the velocity of the airflow directly at the primary airflow outlet 28 is around 30 m/s-35 m/s.

Figure 7:
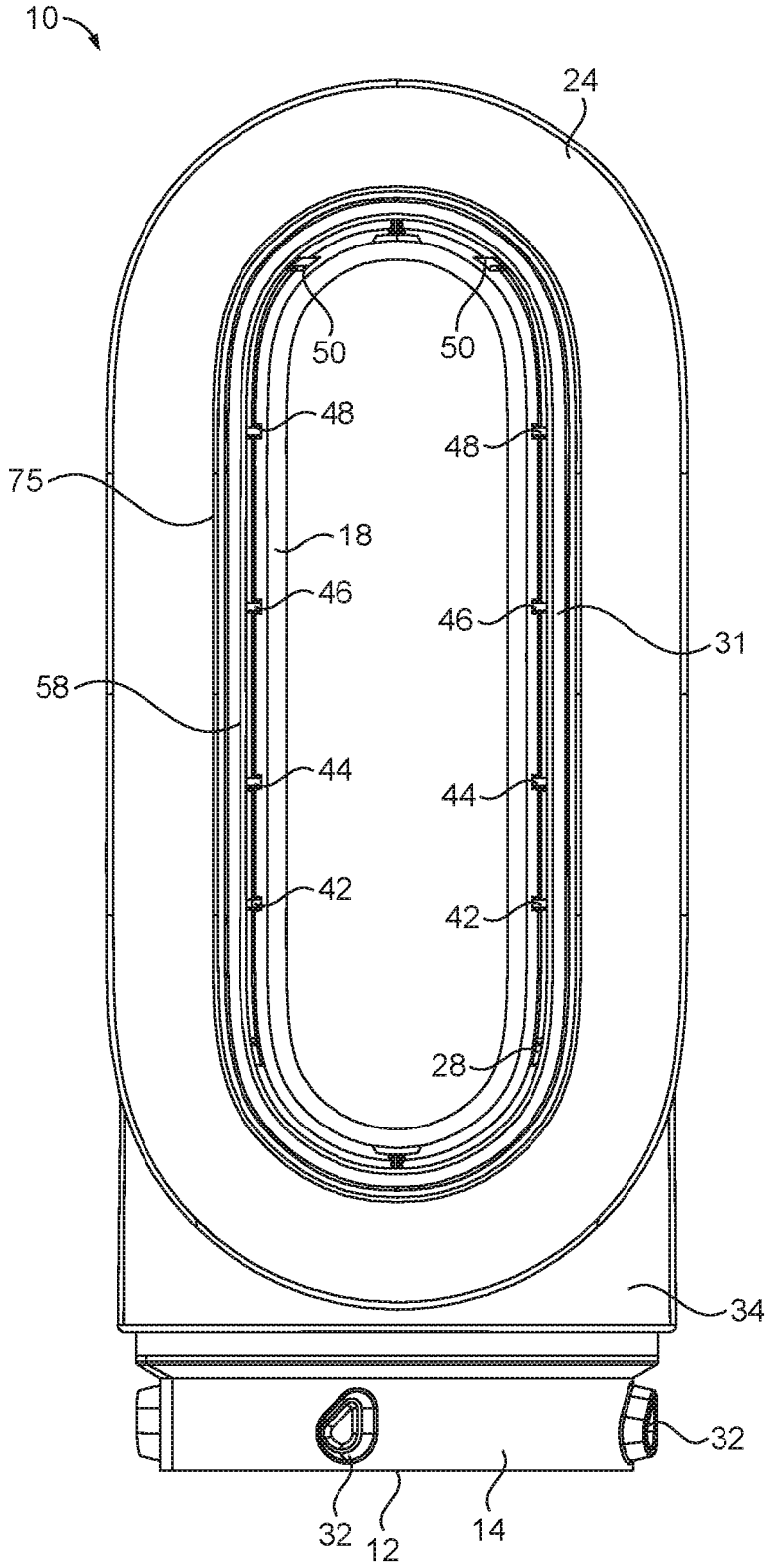
FIG. 7 is a front view of the attachment.
Figure 8:
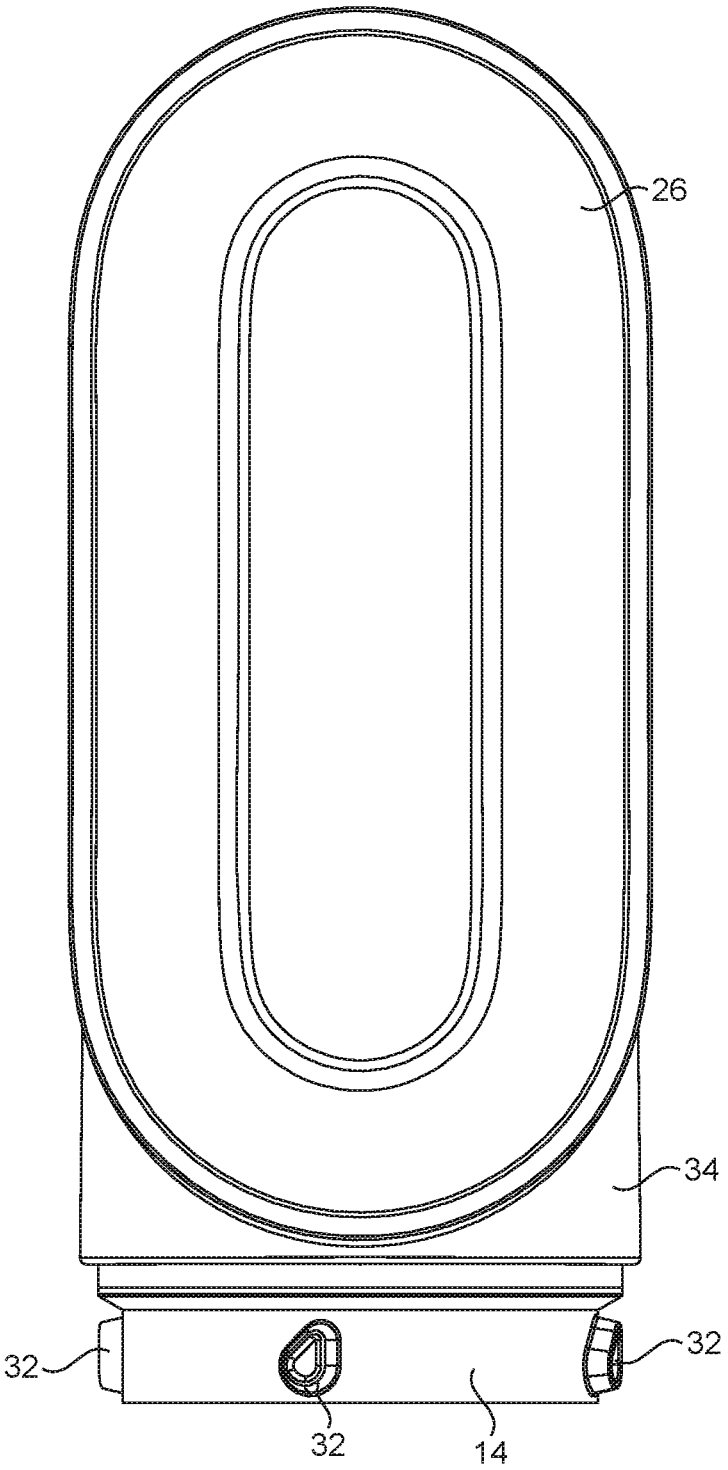
FIG. 8 is a rear view of the attachment.

The front view of the attachment shown in FIG. 7 shows the primary air outlet 28 with five vanes 42, 44, 46, 48, 50 partially visible therethrough. It can be seen that the outlet end of the vanes 42, 44, 46, 48, 50 are not evenly spaced, but rather spaced to provide a balanced distribution of the outlet airflow.

With reference to FIG. 10, the inlet end of each vane 42, 44, 46, 48, 50 is in alignment with the direction of the incident primary airflow entering the attachment through the primary air inlet 12. The outlet end of each vane 42, 44, 46, 48, 50 is in alignment with the direction of the emitted primary airflow exiting the attachment 10 through the primary air outlet 28.

Figure 11:
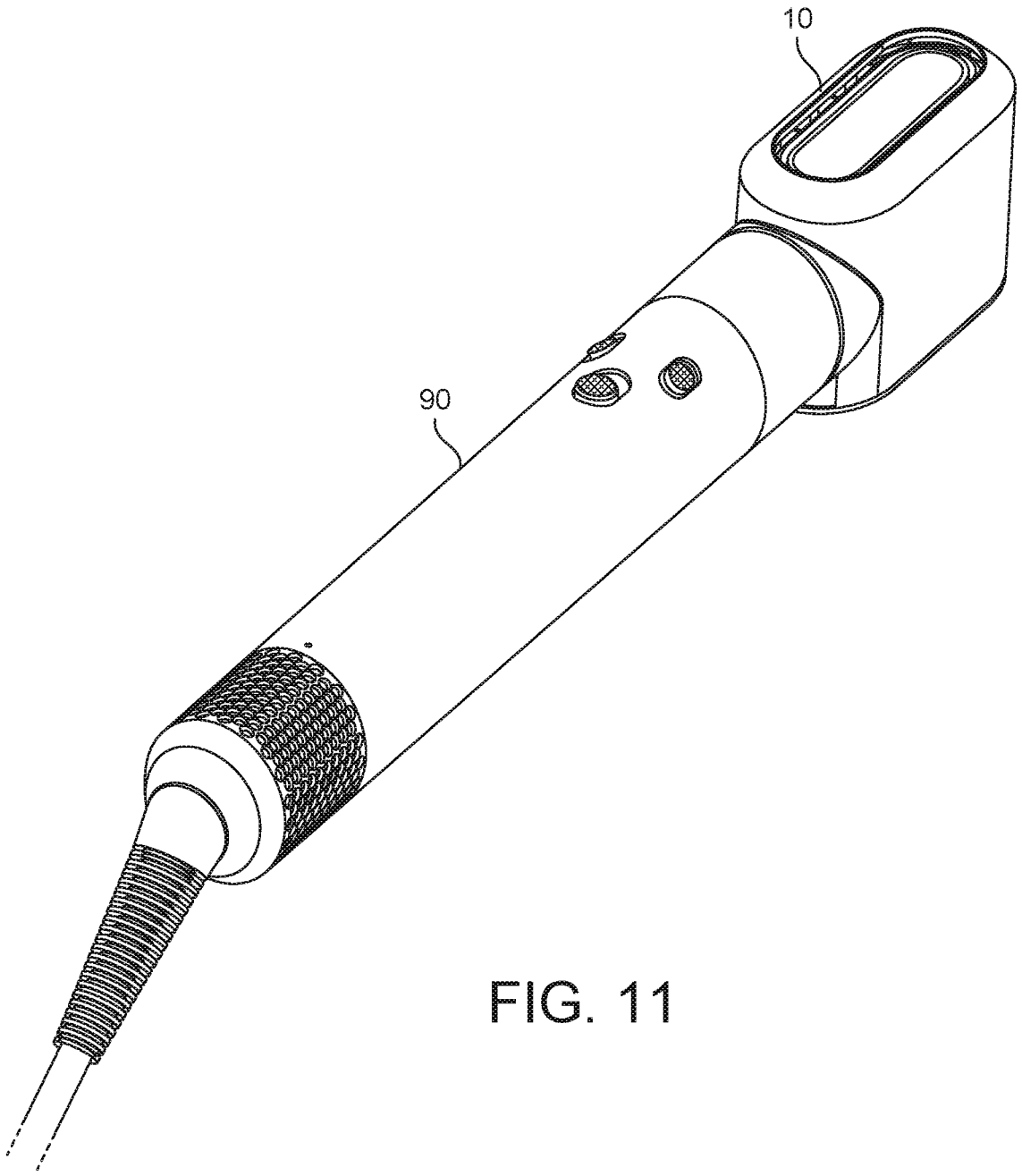
FIG. 11 is a top perspective view of an example of a hot air styling device to which the attachment may be connected.

In use, the attachment 10 is attached to a haircare device 90, as shown in FIG. 11. The temperature of airflow emitted from the haircare device can be warm, ambient or cool. The first duct 35 is in fluid communication with the primary air inlet 12. When heated airflow is emitted from the haircare device 90 and flows through the first duct 35 to the primary airflow outlet 28, then the inner wall 38 and the outer wall 56 can increase in temperature. The region between the outer wall 56 and the cool wall 76 comprises a second duct 37 which functions to insulate the outer wall 56.

In use, the second duct 37 is filled with ambient air which enters the second duct 37 at the secondary air inlet 30 and exits the second duct 37 at a secondary air outlet 31. With reference to FIG. 6, the cool wall 76 and the outer wall 56 extend approximately parallel to one another across a majority of the outer wall 56. In proximity to the primary air outlet 28 and secondary air outlet 31, the cool wall 76 defines the annular front face 24 at a chamfer angle, y. In the embodiment illustrated, the annular front face 24 terminates beyond the primary air outlet 28. In other words, the secondary air outlet 31 is in a different plane to the primary air outlet 28.

Again, with reference to FIG. 6, the inner wall 38 and the outer wall 56 extend approximately parallel to one another along a majority of the inner wall 38. In proximity to the primary air outlet 28 and secondary air outlet 31, the outer wall 56 inclines towards the inner wall 38, thereby reducing the cross-sectional area of the first duct 35. Consequently, the primary airflow velocity and thrust force at the primary airflow outlet 28 is greater than the velocity and thrust force of the incident airflow from the haircare device 90. The primary airflow forms an air jet at the primary airflow outlet 28.

The inclined front face 24 of the cool wall 76 functions to direct the secondary airflow towards the primary airflow and consequently the secondary airflow is entrained by the primary airflow, thereby moving air through the second duct 37 and drawing ambient air in through the secondary air inlet 30. Ambient air moving through the second duct 37 enhances the efficacy of the cool wall 76. However, the secondary airflow is cooler than the heated primary airflow and therefore relative proportions of the secondary and primary airflow should be controlled in order to optimise the airflow temperature experienced by the user. Such control is realized by an outlet nozzle geometry comprised of the dimensions and relative location of the primary airflow outlet 28 and the secondary airflow outlet 31.

The width, W, of the primary airflow outlet is a factor in determining the primary airflow velocity exiting the attachment. In a preferred embodiment, the width, W, of the primary airflow outlet is 1 mm to 4 mm, preferably around 1.6 mm. In a preferred embodiment, the inclination of the outer wall towards the inner wall in proximity to the primary air outlet results in an outlet airflow angle, R, of 1° to 15°, preferably around 5°.

The inclined front face 24 of the cool wall 76 terminates at a distance, C, beyond the primary airflow outlet 28. In a preferred embodiment the distance, C, is 1 mm to 8 mm, preferably around 4 mm. In a preferred embodiment, the annular front face 24 of the cool wall 76 subtends the general cool wall plane by a chamfer angle, y, of 1° to 90°, preferably around 45°.

The outlet nozzle geometry can also determine, in use, a main airflow jet area of the combined primary and secondary airflow jet. In an exemplary embodiment, the airflow in the main airflow jet area has a velocity of around 20 m/s. In particular, the chamfer angle has a significant effect on the distance between the first end 75 of the attachment and the main airflow jet area. In a preferred embodiment, the main airflow jet area commences around 4 cm from the first end 75 of the attachment and may extend up to around 25 cm from the first end 75.

In a preferred embodiment, the dimensions of the attachment are approximately 65 mm from the first end 75 to the second end 77 and approximately 100 mm in height from the top section of the cool wall to the distal end of the collar 14. It is also shown in FIG. 7 that the vanes within the first duct are visible when the attachment is assembled. The vanes are positioned approximately 5 mm from the edge of the primary air outlet in order to avoid splitting of the airflow.

The primary air outlet is an elongate ring in shape and in a preferred embodiment has a height to width ratio of approximately 3:1.

FIG. 9 shows an example of a hot air styling device to which the attachment 10 may be connected. The hot air styling device comprises a generally tubular handle having an air inlet and an air outlet at opposing ends. At the air inlet, an array of apertures extend around and partially along the handle. A fan unit (not shown) is housed within the handle and comprises a fan and a motor. In use, the motor drives the fan and air is drawn in through the air inlet, along an air flow path which extends through the length of the handle. The air is optionally heated by a heater (not shown) before exiting the hot air styling device at the air outlet.

Alternative embodiments of the attachment may comprise different arrangements of vanes. For example, more than five vanes or fewer than five vanes may be used, and split vanes and vanes having an aerofoil cross-section may be present in any combination.

The attachment 10 may be fabricated from any suitable heat resistant material, and in a preferred embodiment, is fabricated from glass-filled nylon. The highest preferred operating temperature of such an attachment 10 connected to a hot air styling device is approximately 130 degrees centigrade.

In an alternative embodiment, it may be desirable to produce a reduced exit airflow velocity from an attachment 10 whilst utilizing a similar hot air styling device to provide the input airflow. This may be achieved by increasing the overall dimensions of the attachment 10. For example, each of the overall depth, height and width of the attachment may be 10 mm greater, and the air outlet may be increased to 3 mm.

The invention is not limited to the detailed description given above. Variations will be apparent to the person skilled in the art.

The invention claimed is:

1. An attachment for a hair styling apparatus comprising:

an annular duct having an air inlet for receiving an airflow from a hair styling apparatus; and at least two or more vanes located within the duct for directing the airflow from the air inlet towards an air outlet, wherein the duct has a curved top section joined to a curved lower section by straight side sections, and the at least two or more vanes are positioned within the straight side sections, and wherein each of the at least two or more vanes have an arc form.

2. The attachment of claim 1, wherein the at least two or more vanes are noncontiguous with the air outlet.

3. The attachment of claim 2, wherein the at least two or more vanes are set back from the air outlet by a distance in the range of 2 to 9 mm.

4. The attachment of claim 2, wherein the at least two or more vanes are set back from the air outlet by a distance in the range of 4 to 7 mm.

5. The attachment of claim 1, wherein the at least two or more vanes have an aerofoil-shaped cross-section.

6. The attachment of claim 1, wherein the at least two or more vanes are a split vane having a minor section and a major section.

7. The attachment of claim 1, wherein the at least two or more vanes comprise ten vanes that are fixed within the duct.

8. An attachment for a hair styling apparatus comprising:

an annular duct having an air inlet for receiving an airflow from a hair styling apparatus; and at least one vane located within the duct for directing the airflow from the air inlet towards an air outlet, wherein the duct has a curved top section joined to a curved lower section by straight side sections, and the at least one vane is positioned within the straight side sections, and wherein the at least one vane has an arc form and is a split vane having a minor section and a major section.

9. The attachment of claim 8, wherein the at least one vane is set back from the air outlet by a distance in the range of 2 to 9 mm.

10. The attachment of claim 8, wherein the duct is defined by an inner wall and an outer wall, and the at least one vane is a lamina extending between the inner wall and the outer wall.

11. The attachment of claim 8, comprising two or more vanes.

12. The attachment of claim 8, wherein the at least one vane is noncontiguous with the air outlet.

13. An attachment for a hair styling apparatus comprising:

an annular duct having an air inlet for receiving an airflow from a hair styling apparatus; and at least one vane located within the duct for directing the airflow from the air inlet towards an air outlet, wherein the duct has a curved top section joined to a curved lower section by straight side sections, and the at least one vane is positioned within the straight side sections, and wherein the at least one vane has an arc form and is noncontiguous with the air outlet.

14. The attachment of claim 13, wherein the at least one vane is set back from the air outlet by a distance in the range of 2 to 9 mm.

15. The attachment of claim 13, wherein the duct is defined by an inner wall and an outer wall, and the at least one vane is a lamina extending between the inner wall and the outer wall.

16. The attachment of claim 13, comprising two or more vanes.

17. The attachment of claim 1, wherein the duct is defined by an inner wall and an outer wall, and the at least two or more vanes are a lamina extending between the inner wall and the outer wall.

18. The attachment of claim 1, wherein respective outlet ends the at least two or more vanes are not evenly spaced.

* * * * *